US006464450B1

(12) United States Patent
Fischer

(10) Patent No.: US 6,464,450 B1
(45) Date of Patent: Oct. 15, 2002

(54) FUEL PUMP

(75) Inventor: John Gardner Fischer, Goodrich, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/656,465

(22) Filed: Sep. 6, 2000

(51) Int. Cl.[7] ..... F04D 1/04
(52) U.S. Cl. ..... 415/55.1; 416/228
(58) Field of Search ..... 415/55.1, 55.2, 415/55.3, 55.4; 416/189, 228

(56) References Cited

U.S. PATENT DOCUMENTS 5,338,165 A * 8/1994 Brockner et al. ..... 417/423.1
5,516,259 A * 5/1996 Niederkofler et al. ..... 415/55.1

* cited by examiner

*Primary Examiner*—Edward K. Look
*Assistant Examiner*—Richard A. Edgar
(74) *Attorney, Agent, or Firm*—Vincent A. Cichosz

(57) ABSTRACT

A fuel pump for a vehicle includes a pump section having a flow channel and a rotatable impeller cooperating with said flow channel to pump fuel therethrough. The fuel pump also includes a motor section disposed adjacent the pump section and having a motor to rotate the impeller. The fuel pump further includes an outlet section disposed adjacent the motor section to allow pumped fuel to exit the fuel pump. The pump section includes a mechanism for minimizing leakage of fuel from the flow channel radially.

10 Claims, 2 Drawing Sheets

FUEL PUMP

TECHNICAL FIELD

The present invention relates generally to fuel pumps and, more particularly, to a fuel pump of a vehicle.

BACKGROUND OF THE INVENTION

It is known to provide a fuel tank in a vehicle to hold fuel to be used by an engine of the vehicle. It is also known to provide a fuel pump to pump fuel from the fuel tank to the engine. One type of fuel pump is known as a high-pressure turbine fuel pump. The high-pressure turbine fuel pump typically includes an impeller rotatable between inlet and outlet plates. The impeller is of a closed vane type to improve pump efficiency and performance. The impeller has a hub portion, a plurality of blade tips extending radially from the hub portion and disposed circumferentially thereabout and a peripheral ring portion extending radially from the blade tips. However, the closed vane impeller is hampered by flow loss due to wear of a peripheral ring portion that shrouds the blade tips of the impeller.

The peripheral ring that shrouds the blade tips of the closed vane impeller improves pump performance by providing a rotational surface that aids to direct the fluid into a flow channel. The peripheral ring also functions as an axial sealing surface between the fluid pressure within the flow channel and the fluid pressure surrounding a major diameter of the impeller. When the fuel pump is operated in fuel containing concentration of abrasive contaminants, the peripheral ring can wear and result in a loss of flow.

Therefore, it is desirable to minimize the flow loss associated with axial wear of the peripheral ring portion of the impeller while maintaining performance benefits the peripheral ring portion provides in a fuel pump for a vehicle. It is also desirable to provide a fuel pump for a fuel tank in a vehicle that eliminates higher cost and process infeasible materials such as ceramic plates and impeller. It is further desirable to improve fuel pump durability using existing low cost materials and production feasible methods for a fuel pump for a fuel tank in a vehicle.

SUMMARY OF THE INVENTION

It is, therefore, one object of the present invention to provide a fuel pump for a fuel tank in a vehicle which eliminates a sealing function of a peripheral ring portion of an impeller.

It is another object of the present invention to provide a fuel pump for a vehicle that minimizes flow loss associated with axial wear of a peripheral ring portion of an impeller.

To achieve the foregoing objects, the present invention is a fuel pump for a vehicle including a pump section having a flow channel and a rotatable impeller cooperating with the flow channel to pump fuel therethrough. The fuel pump also includes a motor section disposed adjacent the pump section and having a motor to rotate the impeller. The fuel pump further includes an outlet section disposed adjacent the motor section to allow pumped fuel to exit the fuel pump. The pump section includes a mechanism for minimizing leakage of fuel from the flow channel radially.

One advantage of the present invention is that a new fuel pump is provided for a vehicle. Another advantage of the present invention is that the fuel pump uses existing low cost materials and production feasible methods. Yet another advantage of the present invention is that the fuel pump has improved fuel pump durability due to elimination of a dynamic sealing surface. Still another advantage of the present invention is that the fuel pump has improved fuel pump efficiency due to reduced friction at the impeller outside diameter surface.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT

Figure 1:
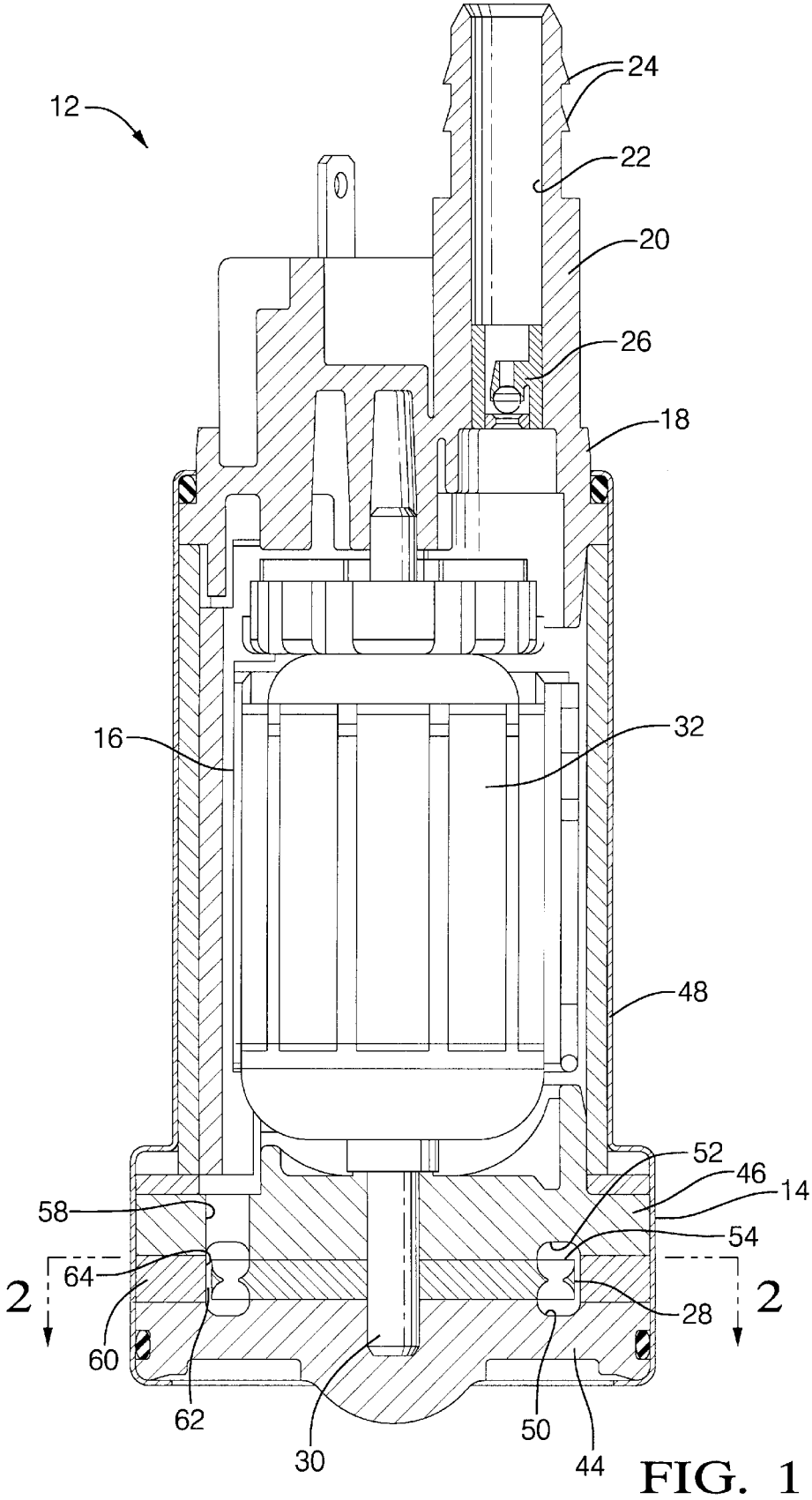
FIG. 1 is a fragmentary elevational view of a fuel pump, according to the present invention.
Figure 2:
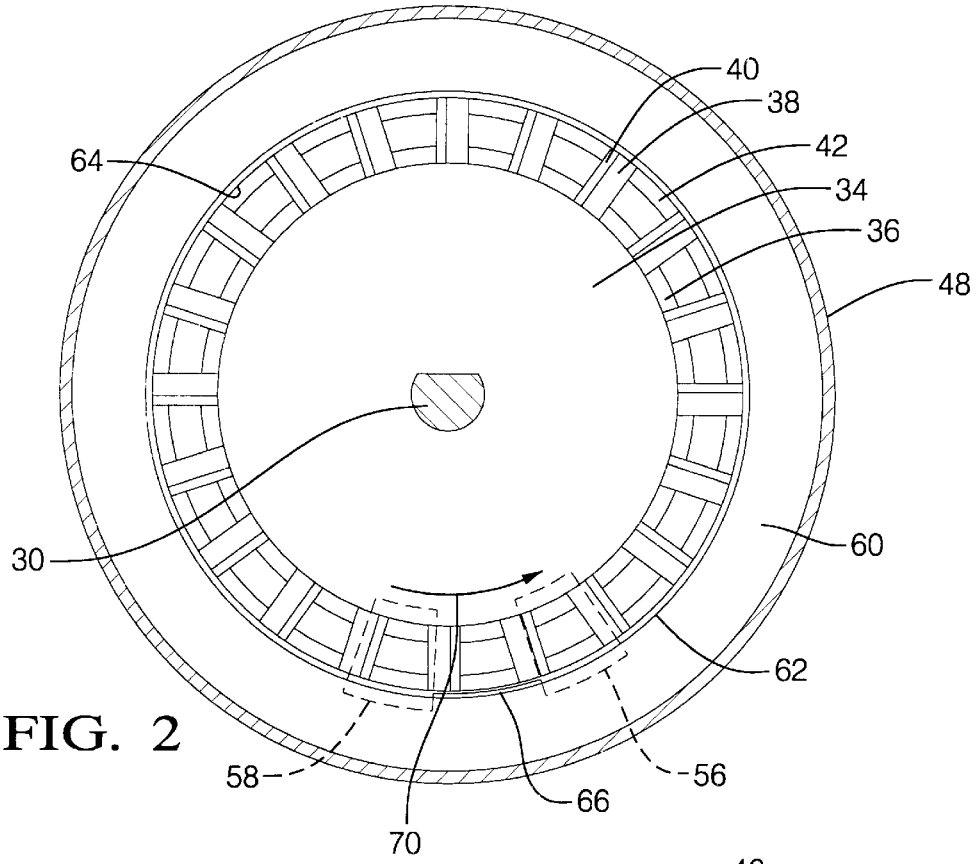
FIG. 2 is a sectional view taken along line 2—2 of FIG. 1.
Figure 3:
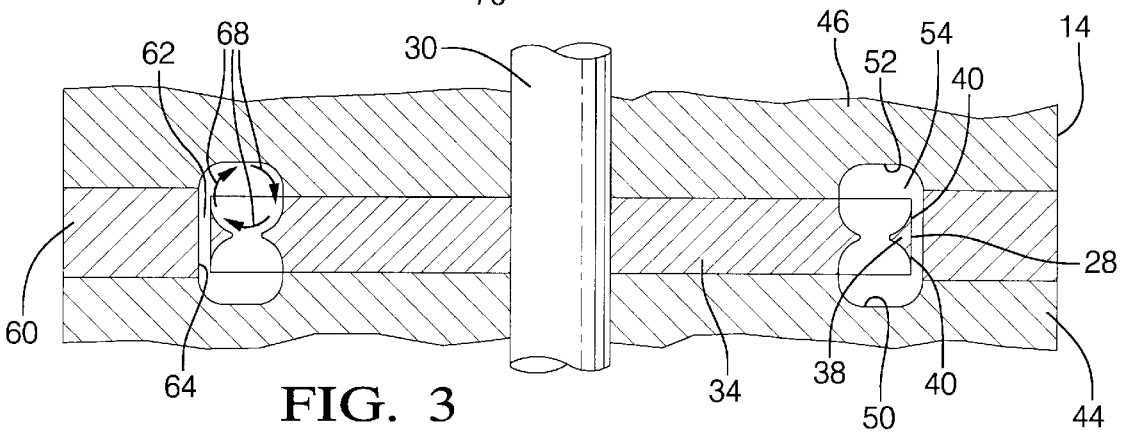
FIG. 3 is a fragmentary elevational view of a pump section of the fuel pump of FIG. 1.
Figure 4:
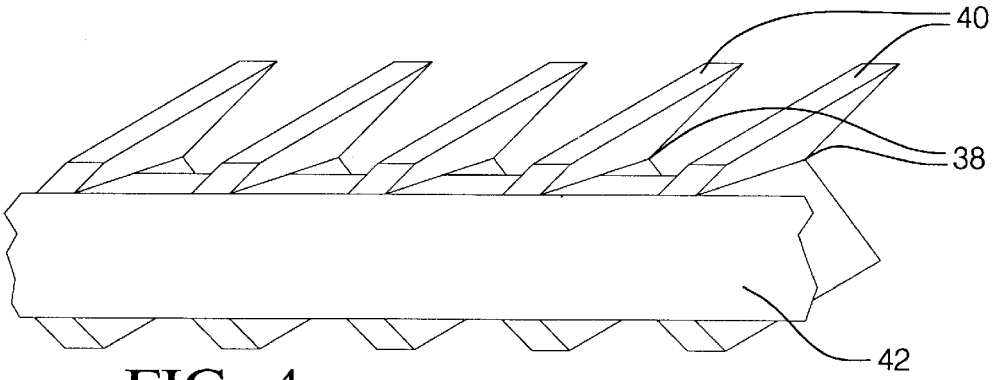
FIG. 4 is an elevational view of a portion of an impeller of the pump section of FIG. 3.

Referring to the drawings and in particular FIGS. 1 and 2, one embodiment of a fuel pump 12, according to the present invention, is shown for a vehicle (not shown). The fuel pump 12 includes a pump section 14 at one axial end, a motor section 16 adjacent the pump section 14 and an outlet section 18 adjacent the motor section 16 at the other axial end. As known in the art, fuel enters the pump section 14, which is rotated by the motor section 16, and is pumped past the motor section 16 to the outlet section 18. The outlet section 18 has an outlet member 20 extending axially with a passageway 22 extending axially therethrough. The outlet member 20 also has a plurality of projections or barbs 24 extending radially outwardly for attachment to a conduit (not shown). The outlet member 20 also includes a check valve 26 disposed in the passageway 22. It should be appreciated that the fuel flowing to the outlet section 18 flows into the outlet member 20 and through the passageway 22 and check valve 26 when open to the conduit. It should also be appreciated that, except for the pump section 14, the fuel pump 12 is conventional and known in the art.

Referring to FIGS. 1 through 4, the pump section 14 includes an impeller 28 mounted to a rotatable shaft 30 of a motor 32 of the motor section 16 for rotation therewith. The impeller 28 is generally planar and circular in shape. The impeller 28 has a hub portion 34 attached to the shaft 30 by suitable means (not shown). The impeller 28 has an interior web portion 36 surrounding the hub portion 34. The impeller 28 also has a plurality of blades 38 extending radially from the interior web portion 36 and disposed circumferentially thereabout. The blades 38 have blade tips 40 extending axially and circumferentially forming a generally "V" shaped. The impeller 28 has a peripheral ring portion 42 extending radially from the blades 38 to shroud the blade tips 40. The peripheral ring portion 42 has an axial shroud height less than an axial blade height of the blade tips 40. The impeller 28 is made of a rigid material such as plastic. It should be appreciated that the small blades or serrations (not shown) can be added to the outside diameter of the peripheral ring portion 42 to prevent the potential for counter flow of fluid. It should also be appreciated that the blade tips 40 are shrouded by the peripheral ring portion 42 that forms the desired flow shaping geometry, but does not extend for the full height of the blades 38, thereby allowing the corners of the blade tips 40 to impart a momentum to the fluid contained in a flow channel 54 to be described and eliminates the potential of counter flow within eddy currents formed by the fluid flow exiting the peripheral ring portion 42.

The pump section 14 also includes an inlet plate 44 disposed axially on one side of the impeller 28 and an outlet plate 46 disposed axially on the other side of the impeller 28. The inlet plate 44 and outlet plate 46 are generally planar and circular in shape. The inlet plate 44 and outlet plate 46 are enclosed by a housing 48 and fixed thereto. The inlet plate 44 and outlet plate 46 have an inlet or first recess 50 and an outlet or second recess 52, respectively, located axially opposite the blade tips 40 adjacent to the peripheral ring portion 42 to form a flow channel 54 for a function to be described. The recesses 50 and 52 are annular and allow fuel to flow therethrough from an inlet port 56 (FIG. 2) to an outlet port 58 of the pump section 14. It should be appreciated that the impeller 28 rotates relative to the inlet plate 44 and outlet plate 46 and the inlet and outlet plates 44 and 46 are stationary.

The pump section 14 also includes a spacer ring 60 disposed axially between the inlet plate 44 and outlet plate 46 and spaced radially from the impeller 28 to form a gap 62 therebetween. The spacer ring 60 is fixed to the housing 38 and is stationary relative to the impeller 28. The spacer ring 60 is generally planar and circular in shape. The spacer ring 60 has an inner diameter 64 that is of equal value to the outside diameter of the flow channel 54. The outer diameter of the peripheral ring portion 42 is in close radial proximity to the inner diameter 64 of the spacer ring 60. The gap 62 between the outer diameter of the impeller 28 and the inner diameter 64 of the spacer ring 60 is maintained at a distance adequate to prevent annular counter flow while maintaining clearance for rotation of the impeller 28. The spacer ring 60 may have a stripper radius portion 66 extending radially and circumferentially into the gap 62 that forms a reduced cross-sectional area or flow stripper between the inlet and outlet ports 56 and 58. It should be appreciated that fluid flows into the inlet recess 50 and through the flow channel 54 and out the outlet recess 52 as indicated by flow velocity vectors 68.

In operation of the fuel pump 12, the motor 32 rotates the shaft 30, which in turn, rotates the impeller 28 as indicated by the arrow 70. The fluid velocity created at the rotating surface of the outside diameter or surface of the peripheral ring portion 42 of the impeller 28 coupled with the viscous force gradient within the fluid cause the fluid such as fuel to flow. The corners of the blade tips 40 impart a momentum to the fluid contained in the flow channel 54. The fuel flows from the inlet port 56 through the flow channel 54 to the outlet port 58 without the potential of counter flow within the eddy current formed by the fluid flow exiting the peripheral ring portion 42. It should be appreciated that this configuration eliminates outer diameter sealing surface wear by using the static spacer ring 60 as the axial seal, while maintaining the flow shaping geometry benefits of a rotating outer diameter peripheral ring portion 42 of the impeller 28. It should also be appreciated that frictional torque losses are reduced, eliminating the surface contact associated with the rotational sealing function. It should further be appreciated that pump durability is improved by shifting the axial outer diameter sealing function from the rotating peripheral ring portion 42 of the impeller 28 to the static outer diameter spacer ring 60 while maintaining the rotational flow direction benefits and performance benefits of the peripheral ring portion 42.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

I claim:

1. A fuel pump for a vehicle comprising:

a pump section having a flow channel and a rotatable impeller cooperating with said flow channel to pump fuel therethrough;

a motor section disposed adjacent said pump section and having a motor to rotate said impeller;

an outlet section disposed adjacent said motor section to allow pumped fuel to exit said fuel pump; and said pump section including a spacer ring spaced radially from said impeller and having an inner diameter thereof equal to an outer diameter of said flow channel, said impeller having a peripheral ring portion forming an outside diameter of said impeller and being in close radial proximity to said inner diameter of said spacer ring, an inner web portion spaced radially from said peripheral ring portion, and a plurality of blades disposed between said inner web portion and said peripheral ring portion and circumferentially therealong, said peripheral ring portion having an axial height less than an axial height of said blade tips.

2. A fuel pump as set forth in claim 1 wherein said blades have blade tips extending radially and circumferentially.

3. A fuel pump as set forth in claim 2 wherein each of said blades form a generally V shape.

4. A fuel pump as set forth in claim 3 wherein said pump section includes an inlet plate disposed axially adjacent one side of said impeller.

5. A fuel pump as set forth in claim 4 wherein said pump section includes an outlet plate disposed axially adjacent an opposed side of said impeller.

6. A fuel pump as set forth in claim 1 including a housing enclosing said pump section and said spacer ring being fixed to said housing and stationary relative to said impeller.

7. A fuel pump for a fuel tank in a vehicle comprising:

a housing;

a pump section disposed in said housing having an inlet plate and an outlet plate forming a flow channel and a rotatable impeller disposed between said inlet plate and said outlet plate and cooperating with said flow channel to pump fuel therethrough;

a motor section disposed in said housing adjacent said pump section and having a motor to rotate said impeller;

an outlet section disposed in said housing adjacent said motor section to allow pumped fuel to exit said fuel pump; and said pump section including a spacer ring spaced radially from said impeller and being fixed to said housing and stationary relative to said impeller and having an inner diameter thereof equal to an outer diameter of said flow channel, said impeller having a peripheral ring portion forming an outside diameter of said impeller and being in close proximity to said inner diameter of said spacer ring, an inner web portion spaced radially from said peripheral ring portion, and a plurality of blades disposed between said inner web portion and said peripheral ring portion and circumferentially therealong, said peripheral ring portion having an axial height less than an axial height of said blade tips.

8. A fuel pump as set forth in claim 7 wherein said blades have blade tips extending radially and circumferentially.

9. A fuel pump as set forth in claim 8 wherein each of said blades form a generally V shape.

10. A fuel pump for a vehicle comprising:

a housing;

a pump section disposed in said housing having an inlet plate and an outlet plate forming a flow channel and a rotatable impeller disposed between said inlet plate and said outlet plate and cooperating with said flow channel to pump fuel therethrough, said impeller having a hub portion, an inner web portion surrounding said hub portion, a plurality of blades disposed circumferentially about said hub portion and a peripheral ring portion extending radially from said blades;

a motor section disposed in said housing adjacent said pump section and having a motor to rotate said impeller;

an outlet section disposed in said housing adjacent said motor section to allow pumped fuel to exit said fuel pump; and wherein said blades have blade tips extending radially and circumferentially and each of said blades form a generally V shape and wherein said peripheral ring portion has an axial height less than an axial height of said blade tips.

* * * * *